US007025806B2

(12) United States Patent
Coppom et al.

(10) Patent No.: US 7,025,806 B2
(45) Date of Patent: Apr. 11, 2006

(54) ELECTRICALLY ENHANCED AIR FILTRATION WITH IMPROVED EFFICACY

(75) Inventors: Rex Coppom, Longmont, CO (US); Sven Coppom, Boulder, CO (US); Brian Coppom, Longmont, CO (US)

(73) Assignee: StriônAir, Inc., Louisville, CO (US)

( * ) Notice: Subject to any disclaimer, the term of this patent is extended or adjusted under 35 U.S.C. 154(b) by 0 days.

(21) Appl. No.: 10/721,940

(22) Filed: Nov. 25, 2003

(65) Prior Publication Data

US 2005/0109204 A1 May 26, 2005

(51) Int. Cl.
*B03C 3/155* (2006.01)

(52) U.S. Cl. ..... 95/59; 55/DIG. 5; 96/67; 96/69; 264/258; 264/DIG. 48

(58) Field of Classification Search ..... 96/15, 96/17, 66, 67, 69, 88; 95/59, 69, 70, 78; 55/DIG. 5, DIG. 39; 264/258, DIG. 48
See application file for complete search history.

(56) References Cited

U.S. PATENT DOCUMENTS

| | | | | | |
|---|---|---|---|---|---|
| 2,822,058 | A * | 2/1958 | Roos et al. | ..... | 96/66 |
| 2,847,082 | A * | 8/1958 | Roos | ..... | 96/67 |
| 2,908,348 | A | 10/1959 | Rivers et al. | ..... | 96/67 |
| 3,997,304 | A * | 12/1976 | Carr | ..... | 96/67 |
| 4,354,861 | A | 10/1982 | Kalt | ..... | 96/69 |
| 4,509,958 | A | 4/1985 | Masuda et al. | ..... | 95/60 |
| 4,715,870 | A | 12/1987 | Masuda et al. | ..... | 96/67 |
| 4,940,470 | A | 7/1990 | Jaisinghani et al. | ..... | 95/78 |
| 4,978,372 | A * | 12/1990 | Pick | ..... | 96/67 |
| 5,108,470 | A * | 4/1992 | Pick | ..... | 96/58 |
| 5,403,383 | A | 4/1995 | Jaisinghani | ..... | 95/69 |
| 5,474,600 | A * | 12/1995 | Volodina et al. | ..... | 96/57 |
| 5,549,735 | A * | 8/1996 | Coppom | ..... | 96/63 |
| 5,573,577 | A * | 11/1996 | Joannou | ..... | 96/66 |
| 5,593,476 | A * | 1/1997 | Coppom | ..... | 95/78 |
| 5,807,425 | A * | 9/1998 | Gibbs | ..... | 96/66 |
| 5,846,302 | A * | 12/1998 | Putro | ..... | 96/66 |
| 5,855,653 | A * | 1/1999 | Yamamoto | ..... | 96/58 |
| 5,902,364 | A * | 5/1999 | Tokar et al. | ..... | 55/498 |
| 5,922,096 | A * | 7/1999 | Stemmer | ..... | 55/483 |
| 6,123,752 | A | 9/2000 | Wu et al. | ..... | 96/69 |
| 6,322,615 | B1 * | 11/2001 | Chapman | ..... | 96/67 |
| 6,491,743 | B1 * | 12/2002 | Joannou et al. | ..... | 96/67 |
| 6,497,754 | B1 * | 12/2002 | Joannou | ..... | 96/67 |
| 6,579,350 | B1 * | 6/2003 | Doherty | ..... | 96/67 |
| 2002/0152890 | A1 * | 10/2002 | Leiser | ..... | 95/63 |

FOREIGN PATENT DOCUMENTS

| | | | | |
|---|---|---|---|---|
| JP | 403213107 A | 9/1991 | ..... | 55/521 |

* cited by examiner

*Primary Examiner*—Richard L. Chiesa
(74) *Attorney, Agent, or Firm*—Kent A. Lembke; Hogan & Hartson L.L.P.; Stuart T. Langley

(57) ABSTRACT

A filter assembly particularly useful in electronically enhanced air cleaning systems including a fibrous filter media. A conductive electrode is affixed to the fibrous filter media, so that the conductive electrode makes physical contact to the fibrous filter media in a plurality of substantially planar locations. The conductive electrode is coupled to a potential that enables neutralizing charge that accumulates on the filter media during operation to be removed thereby maintaining high efficiency.

24 Claims, 5 Drawing Sheets

ELECTRICALLY ENHANCED AIR FILTRATION WITH IMPROVED EFFICACY

BACKGROUND OF THE INVENTION

1. Field of the Invention

The present invention relates, in general, to electrically enhanced air filtration and, more specifically, systems and methods for increasing efficiency of electrically enhanced air filtration while avoiding arcing and minimizing the loss of collection efficiency which results from charge accumulation on the fibers of the mechanical filter utilized.

2. Relevant Background

Gas filtration, and more specifically air filtration, is used in a wide variety of applications ranging from automobiles, homes, office buildings and manufacturing facilities. In many cases filtration systems are used to remove pollutants such as dust, particulates, microorganisms and toxins from breathing air, although filtration systems and processes may be used to purify manufacturing environments, process gasses, combustion gasses and the like.

One particular application is for heating, ventilation, and air conditioning (HVAC) systems within buildings. HVAC systems comprise a motor and blower that moves air from a supply through ductwork that distributes the air throughout building spaces. The air supply may be outside air, re-circulated air from inside the building, or a mixture of outside and re-circulated air. Conditioning systems such as heat exchangers, humidifiers, dehumidifiers, and the like are positioned in-line with the ductwork to adjust various characteristics of the supplied air before it is delivered to building spaces. Air filtration systems are placed in-line with the ductwork to filter out particulates and organisms from the air that are present within the flow of air.

Mechanical filters consist of a flat, or pleated, mat of fibers contained in a supporting frame. The filter is sufficiently porous to allow air flow through the filter. In operation, mechanical filters capture particulates and organisms on the filter fibers as the air stream passes through the filter. In order to capture smaller particles, the density of fibers is increased to reduce the space between individual fibers. The smaller the space between the individual fibers, the smaller the size of particle that can be trapped. Unfortunately, as the openings get smaller the resistance to airflow also increases and so the energy required to move air through the filter increases significantly when higher density filters are used. Moreover, as the filter becomes loaded with captured particulates, air flow is further restricted. As a result, high efficiency mechanical filtration is not practical for many applications. Further, mechanical filters become breeding grounds for bacteria and other organisms that are captured. As a result, the mechanical filter can actually become a source of contamination.

Another type of filtration mechanism uses frictional electrostatic technology to improve particulate capture efficiency with less air restriction. Frictional electrostatic filtration uses the fact that the friction of air moving over certain types of materials causes charge transport (i.e., static electricity") that imparts a surface charge on the filter fibers. This surface charge encourages particles that have an opposite charge to attach to the filter fiber. Because the surface charging results from the friction of air flow, electrostatic filters are "self-charging" in that they do not require externally applied electricity. In this manner, particle capture efficiency is increased without increasing the fiber density. While frictional electrostatic filtration is an improvement over pure mechanical filtration, the charge transfer caused by air movement over the filter is relatively modest. Also, the particle efficiency is only improved for particles that have an opposite charge to the filter media. For electrically neutral particles the filter capture efficiency is similar to mechanical filters. Additionally, as particulate matter collects on the filter's fibers they reduce the frictional effect by preventing the airflow from coming into contact with the fiber's surface.

Electret filter media has been developed to enhance the capture efficiency of the filter media using built-in electric fields. When the fibers of an electret media filter are formed, the fibers are charged or polarized by application of an electric field or other technique. This charge increases the initial capture efficiency of the filter in much the same way as frictional electrostatic filters. However, as oppositely charged particles accumulate in the electret filter media the built in charge is neutralized by the particle charge, and filter efficiency returns to what would be more typical of a purely mechanical filter.

Active electrically enhanced air filtration operates on principles similar to frictional electrostatic filters, but uses externally applied electricity to polarize the filter media rather than the self-charging electrostatic effect. Using externally applied electricity enables higher voltages and corresponding higher collection efficiencies. The high voltages required large separation between some components to avoid arcing, which made early units too bulky for some applications. Also, early electrically enhanced filters were criticized because arcing problems that reduced efficiency and produced ozone and they had limited ability to remove all sizes of particulates from the air. However several improved designs have been introduced in recent years. For example, U.S. Pat. No. 5,549,735 and U.S. Pat. No. 5,593,476, which are assigned to StrionAir, Inc., which is the assignee of the present invention, describe an electrically enhanced fibrous air filter that uses polarized filter medium in combination with an upstream pre-charge system to impart a charge on particulates before they reach the polarized filter media. This system uses electrode arrangements that control arcing while at the same time producing a high polarizing field across the filter media.

In order to polarize the filter media utilized in electrically enhanced air filters, the media must be substantially non-conductive. However, the non-conductive media tends to accumulate fiber charge during operation which causes a reduction in particle removal efficiency. Over time, as charge from collected particles accumulates on the oppositely charged fiber sites this charge buildup prevents other incoming charged particles from being attracted to these collection sites. In fact, this accumulated charge will repel incoming particles away from the fibers. Additionally, in electrically enhanced air filters that utilize negative ionization to pre charge particles any pathogens trapped on the filter are bombarded by electrons and negatively charged particles which eventually results in the rupturing of the organism's cell wall killing the pathogen. It is believed that fiber charge buildup repels electrons away from the organism so it now doesn't receive the dosage needed to kill it.

Another electrically enhanced air filter system described in U.S. Pat. No. 4,940,470 and U.S. Pat. No. 5,403,383 issued to Jaisinghani et al. These designs propose a construction in which a ground electrode is in proximity or contact with the filter media while a high-voltage polarizing electrode is placed upstream of the filter. In these designs the ground electrode participates in the application of an electric field that polarizes the filter media. In some embodiments the ground electrode is in physical contact with the filter media. However, these patents and patent applications fail to teach that the ground electrode be configured to conduct accumulated charge away from the filter media. Because the ground electrode was used for field shaping, it was believed to be important that the entire downstream surface of the filter media be substantially conductive so that all of the filter surface was at a similar potential. However, it has been found that this configuration encourages arcing in pleated filter designs because the distance between the ground and the upstream ionizing electrodes varies across the pleats. Further, the continuous contact between the filter surface and the ground electrode interfered with airflow.

Published U.S. patent application 20020152890A1 to Leiser builds on the Jaisinghani et al. by suggesting that a conductive coating be applied to only a portion of the downstream side of the filter media to lessen the occurrence of arcing. While recognizing the arcing problem, the Leiser publication continues to rely on the ground electrode solely for the purpose of applying an electric field to polarize the filter fibers. Significantly, the Leiser publication does not recognize that charge accumulation on the filter fibers during operation will degrade performance over time. Further, the Leiser publication, like the Jaisinghani et al. patents, teaches coating a portion of the pleated filter media which results in a non-uniform distance between the ground electrode and the upstream ionizing electrode. Accordingly, the Leiser publication provides an incomplete solution to the arcing problem and no increase in efficiency or long-term performance. Moreover, the conductive coating applied to the downstream pleats blocks airflow through that portion of the filter media, reducing the effective area available for filtering particles. Because airflow is blocked at the pleats, the air flow dynamics are altered which can distort the pleat shape and further reduce effectiveness of the system.

The electrically enhanced air filtration industry continuously seeks improvements in manufacturability and cost. Although electrically enhanced air filters have proven to have superior performance, mechanical filtration alone has a significant initial cost advantage because of the simplicity of design and the relatively low cost of replacement filters. Many electrically enhanced air filter designs involve specially formed filter media that adds conductive layers, paints, or inks to the filter media to enable electric fields to be established across the media. Jaisinghani et al., for example, requires a conductive layer on the downstream filter surface while Leiser requires a conductive paint applied to the filter media to establish the polarizing electric field. The electrically enhanced air filtration systems described in U.S. Pat. No. 5,549,735 and U.S. Pat. No. 5,593,476 are notable exceptions in that they teach a system with field electrodes that are proximate to but not necessarily attached to the filter media. While proximate electrodes simplify the filter design, it has been found that proximate electrode designs allow the accumulation of charge in the filter media. The present invention addresses these limitations of prior systems by providing a filter design that has the benefits of a field electrode in contact with the filter media to solve the charge accumulation problem while at the same time providing the manufacturing and cost benefits associated with proximity field electrodes.

In view of the above, there remains a need for systems and methods for making and operating electrically enhanced air filters and air filtration systems with improved efficiency. More specifically, there is a need for air cleaning and filtration systems that counteract the effects of charge accumulation during operation so as to provide high cleaning efficiency throughout a long life and in certain configurations support a germicidal effect. There is also a need for a filter media suitable for electrically enhanced air filters that is cost-effective and efficient to manufacture.

SUMMARY OF THE INVENTION

Briefly stated, the present invention involves an electrically enhanced fibrous air filter with increased and long-term efficiency that supports a germicidal effect. The filter assembly in accordance with the present invention is particularly useful in electronically enhanced air cleaning systems including a fibrous filter media. A conductive electrode is affixed to the fibrous filter media, so that the conductive electrode makes physical contact to the fibrous filter media in a plurality of substantially planar locations. The conductive electrode is coupled to a potential that enables neutralizing charge that accumulates on the filter media during operation to be removed thereby maintaining high efficiency.

In another aspect, the present invention involves a method for making a filter media assembly by providing a fibrous filter media and affixing a substantially planar conductive electrode to the fibrous filter media. The conductive electrode physically contacts the fibrous filter media at a plurality of locations. In specific examples, the fibrous filter media is pleated using a glue bead to stabilize the pleats, wherein the act of affixing the conductive electrode comprises using the glue bead to affixing the conductive electrode.

The present invention also involves methods for removing particulates from air. Air flow is directed through a filter media and a substantially uniform electric field is established across the filter media. Particles are collected on the filter media, whereby charge from a collected particle is distributed to the filter media. The collected charge from the filter media is further collected using an electrode that is physically coupled to the filter media. The collected charge is conducted to a power supply or ground or suitable polarity.

DETAILED DESCRIPTION OF THE PREFERRED EMBODIMENTS

The present invention is illustrated and described in terms of an electrically enhanced air filter with an improved filter assembly that enables the application of a filter-polarizing field while at the same time draining off charge that accumulates on the filter media during normal operation. The filter assembly comprises a pleated filter media where the pleats define a plurality of downstream filter tips. A downstream electrode is affixed to the filter assembly to make physical contact with the downstream filter tips at a plurality of locations where the contact is sufficient to drain accumulated surface charge from the filter media even when the filter media is substantially non-conductive.

The filter assembly in accordance with the present invention is particularly useful in electrically enhanced air filters when the downstream electrode is coupled to a system common or ground potential. Alternatively, the downstream electrode is coupled to a power supply of charge of opposite polarity to that of the charge accumulated in the filter. These configurations enable the accumulated charge to be drained off or compensated and the desirable charge state that enhances collection efficiency to be replenished.

The electrically enhanced air filter further includes an upstream electrode that is positioned proximate to the filter media. A voltage source is applied between the upstream electrode and the downstream electrode so as to polarize fibers and uncharged particles within the filter media. In particular implementations, the upstream electrode is covered with an insulating sheath. Optionally, an upstream pre-charge unit is spaced further upstream from the upstream electrode. A voltage source is coupled to the pre-charge unit so as to cause ionization of particulates in a vicinity of the upstream pre-charge unit. In a specific implementation, the quantity and polarity of charge imparted by the pre-charge unit is selected to compensate for charge accumulation on the upstream electrode when particulates of opposite charge transfer charge to the upstream electrode in operation.

Figure 1:
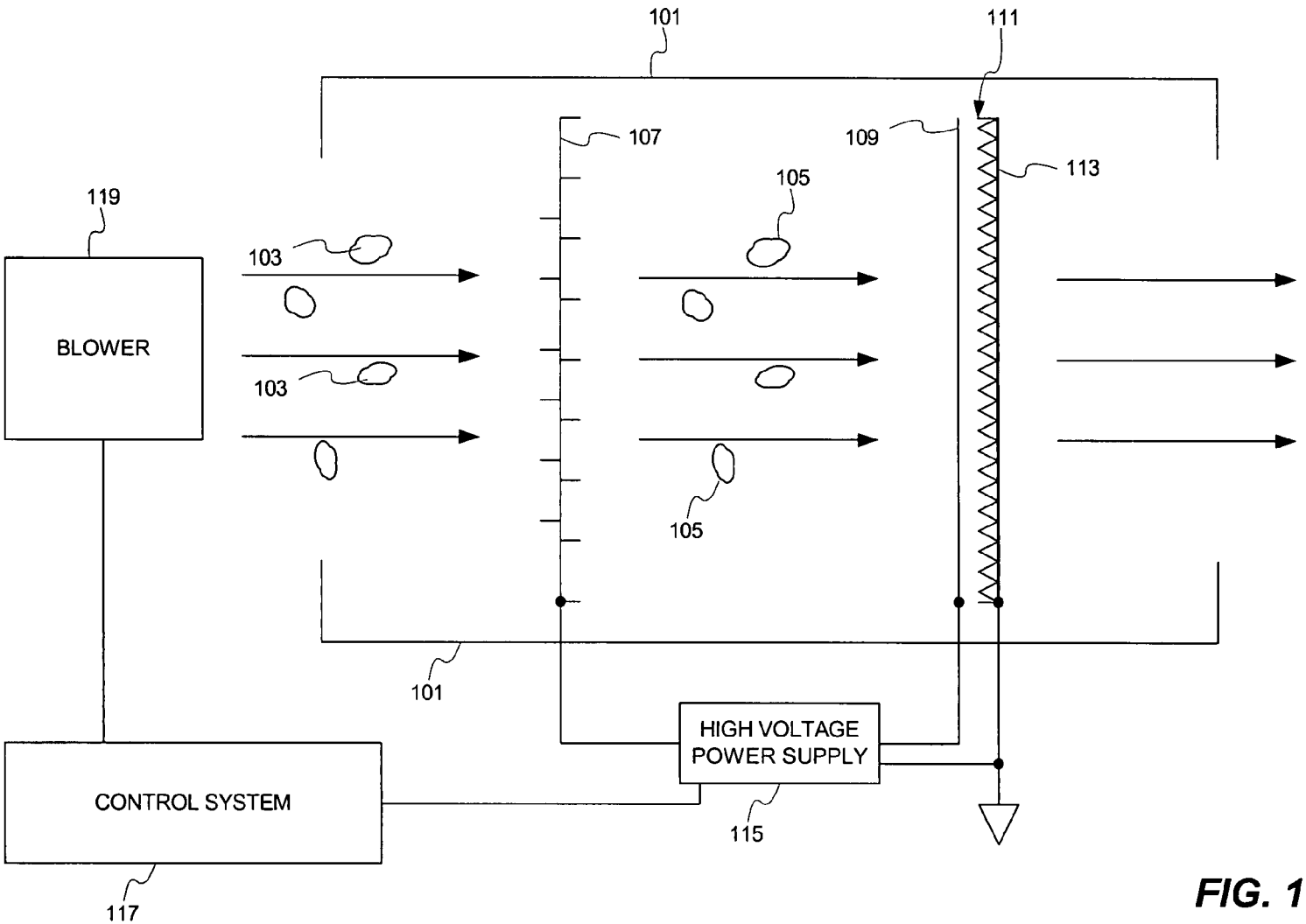
FIG. 1 illustrates functional units within an electrically enhanced air filtration system in accordance with the present invention in block diagram form.

FIG. 1 illustrates functional units within an air filtration system in accordance with the present invention in block diagram form. The components of the air filtration system are generally positioned in line with a confined space that conducts airflow such as ductwork, venting, system housing and the like. In FIG. 1, walls 101 represent any structure that is used to direct air flow through the various electronic filter components. Walls 101 are illustrated as being physically spaced from other filter components, however, systems are typically configured to prevent bypass of air around edges of the filter components to ensure that substantially all air flow through the system is filtered.

The direction of airflow in FIG. 1 is suggested by the arrows. Air flow may be created by an upstream blower 119 or alternatively by a downstream vacuum, natural or induced convection, high pressure storage, and the like. The rate of air flow may be constant or may vary over time to meet the needs of a particular application. In some cases, efficiency of the electrically enhanced filter system may increase with reduced airflow. Airflow rate may be varied by control system 117 to produce a desired particle capture efficiency. The left side of the system shown in FIG. 1 is referred to as the "upstream side" or "source side" while the right side of FIG. 1 is referred to as the "downstream side" or "distribution side". Walls 101 may be formed of any available material including metal, plastic, wood, cloth, paper, composite materials and the like that provides suitable structural support for the particular application and preferably has sufficiently low resistance to air flow. In order to inhibit loss of ions from the precharging section the surfaces of the housing that are exposed to airflow should be ungrounded and are preferably non-conductive. Hence, when a conductive material is used, it can be lined or coated with an insulating material. Alternatively or in addition, a suitable electric potential can be coupled to conductive portions to further inhibit or repel ions traveling between the precharging section and the downstream components.

The source air contains various contaminants 103 such as dust, microorganisms, pollen, toxins, and other types of particulate contamination. Particulates 103 are greatly enlarged for purposes of illustration. Particles 103 range from several microns in size to submicron. Particles 103 may carry a net charge natively, however, most particles 103 are charge neutral. Air flow is directed through pre-charger unit 107 which imparts a charge to at least some of particles 103 to form charged particles 105. In a particular implementation pre-charging unit 107 comprises an array of corona discharge points coupled to a direct current (DC) voltage source in the range of 10K–50K volts provided by, for example, high voltage power supply 115. The direct current voltage on pre-charging unit 107 is referenced to ground or system common.

In addition to charged particles 105, the air stream includes ions generated by the pre-charger unit 107 that are unattached to particles, ions of both polarities that were present in the source air, as well as particles that have a charge originating from some source other than the pre-charger unit 107. These charges eventually reach filter media 111 and contribute in the neutralization of charge sites in filter media 111 that are designed to attract particles. While the description of the present invention focuses on charge transport by particles themselves, it should be understood that the present invention operates to remove all sources of charge that operate to neutralize the electrically enhanced filter's ability to capture particles.

Airflow and charged particles 105 are directed to an upstream electrode 109. Upstream electrode 109 comprises in a particular example a conductive grid or array that is coated with an insulating sheath. The conductive grid is coupled to a high voltage supply 115 to receive the same polarity 10K–50 KV DC voltage that is applied to pre-charge unit 107. The voltage applied to upstream electrode is referenced to the potential of downstream electrode 113, which is system common or ground potential or coupled to a source of opposite-polarity charge as compared to upstream electrode 109 in the embodiment of FIG. 1. The voltage differential between upstream electrode 109 and downstream electrode 113 establishes an electric field that polarizes fibers in filter media 111. The polarized fibers have "charge sites" (shown and described in reference to FIG. 6*a* through FIG. 6*c*). These charge sites tend to attract opposite charges from both charged particles and free ions in the air stream. This electric field also polarizes un-charged particles entering the field.

The insulating sheath on upstream electrode 109 allows relatively very strong electric field to be applied between upstream electrode 109 and downstream electrode 113. The higher electric field may be created by larger voltage differential between upstream electrode 109 and downstream electrode 113 and/or by reduced spacing between upstream electrode 109 and downstream electrode 113. The electric field is established by adjusting the applied voltage and spacing so as to have a high strength electric field to maximize particle collection efficiency but one which does not exceed the breakdown point of the insulation on the upstream electrode in order to prevent arcing. The electric field may be constant (i.e., DC), or may vary over time (e.g., alternating current). Moreover, the electric field may be varied automatically or semi-automatically by control system 117 to compensate for varying environmental conditions. Arcing itself may be detected by an increase in current flow that often precedes an arc, in which case detection of a pre-arc condition may trigger an automatic change in the electric field.

Charged particles 105 that have the same polarity as upstream electrode 109 will be repelled from upstream electrode 109 and so reduce particle buildup on electrode 109. Particles that are charged opposite polarity to that of the insulated electrode will migrate to the area in front of (or on) the insulated electrode. If this process were allowed to continue, the accumulation of charge would screen the upstream electrode 109 and reduce the electric field strength across filter media 111. However, these screening charges are substantially neutralized by the incoming oppositely charged particles 105 and other ions from the pre-charging unit 107 in the embodiment of FIG. 1 to reduce the charge buildup in front of the insulated electrode responsible for a loss of field strength and particle collection efficiency.

Air is directed to filter assembly 111 which mechanically and electronically captures both uncharged particles (mechanically), ionized and polarized particles, as well as other free ions present in the air (e.g., ions that were present in the source air or generated by the pre-charging unit 107). Filter assembly 111 is constructed to provide a suitably low resistance to airflow and to prohibit bypass airflow. In the particular examples, filter assembly 111 is a disposable element that will collect particles 105 during system operation which are then disposed when filter assembly 111 is discarded and replaced. Alternatively, filter assembly 111 may be reused by appropriate cleaning.

Downstream electrode 113 is affixed in contact with a downstream surface of a filter media (201 in FIG. 2) of filter assembly 111. As shown in FIG. 1, downstream electrode 113 is coupled to a system common or ground potential or to a power supply of opposite polarity to the upstream electrode and ionization. Preferably downstream electrode makes contact with the downstream surface of the filter media 201 at multiple locations that are substantially equidistant from a plane defined by upstream electrode 109. The equidistant spacing is used to provide a substantially uniform electric field between downstream electrode 113 and upstream electrode 109 to provide equal polarization of the filter media, which results in more uniform particle collection/distribution over the entire surface of the filter media. As the electric field will tend to break down and arc at the closest point between downstream electrode 113 and upstream electrode 109, equidistant positioning is an important feature.

By coupling downstream electrode 113 to the filter media 201 at the downstream-most locations of the filter media 201, the maximum electric field strength for a given geometry is achievable. It is strongly preferred that filter media 201 be substantially non-conductive so that it does not alter the electric field or shorten the effective distance between downstream electrode 113 and upstream electrode 109.

Most importantly, the downstream electrode 113 also serves as a conduction path for charge that accumulates on filter media 201 during operation from collection of charged particles and other ions in the air stream. As noted, as charge is captured in filter media 201 this cancels out or neutralized the attractive force of sites of opposite polarity charge created by the applied electric field. If allowed to continue, this charge neutralization decreases filter efficiency notably. Depending upon the charge polarity of the collected particles the applied electric field will attract or repel this charge. While the charges within the polarized fibers do not migrate from within the fibers, the charges on the particles are free to migrate along the surface of the fibers if a path to ground or opposite charge is provided. This conduction path is provided by downstream electrode 113, which enables any neutralizing charge to be drained and thereby maintaining high efficiency over the long term. Because the filter media 201 is preferably a non-conductive material, it is desirable that downstream electrode 113 make contact to the filter media 201 at multiple locations throughout the surface area of filter media 201 to provide relatively short conduction paths from any location on filter media 201 to the downstream electrode 113.

Figure 2:
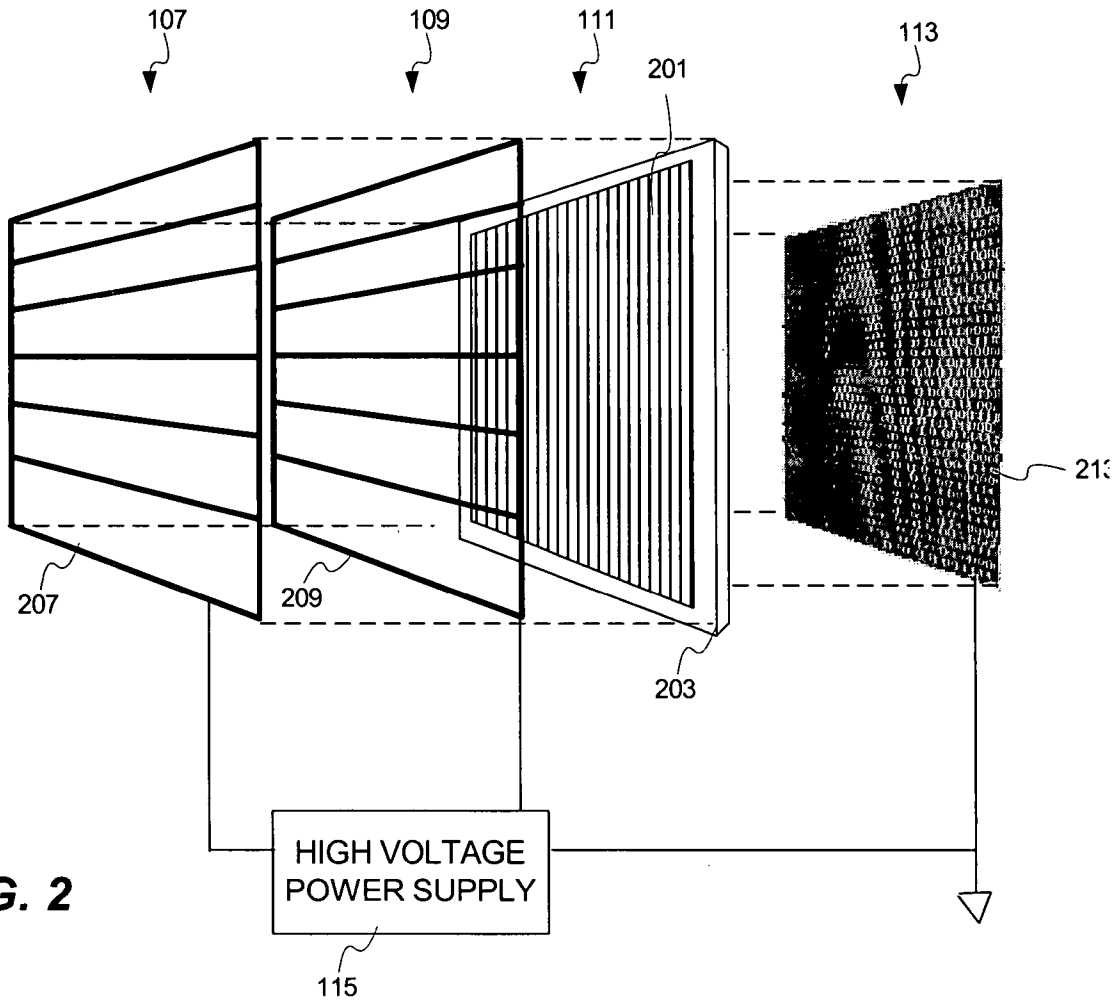
FIG. 2 is an exploded view illustrating components of a particular embodiment of the present invention.

FIG. 2 illustrates an exploded view of a particular implementation of an electrically enhanced filter system in accordance with the present invention. In the embodiment of FIG. 2, pre-charging unit 107 is implemented by an array formed by a conductive wire rack 207. Element 207 comprises any conductive material such as steel, aluminum, copper, alloys and the like. A plurality of corona discharge points, not visible in FIG. 2, are formed on the wire rack 207 and extend downstream towards downstream electrode 113. Element 207 may be covered with an insulating coating with the exception of the corona points which should be exposed. Optionally, wire rack may have one or more corona points that extend in an upstream direction as well. The corona points act as a focus for the applied electric field and allow the ionizing corona discharge caused by the applied electric field to be localized as desired. Any number and arrangement of corona points may be provided to meet the needs of a particular application.

Upstream electrode 109 is implemented by an array formed by a conductive wire rack 209 in the embodiment of FIG. 2. Upstream electrode 209 comprises any conductive material such as steel, aluminum, copper, alloys and the like. Upstream electrode 209 is covered with an insulating coating in the particular examples.

Filter 111 assembly comprises, for example, a disposable filter assembly formed by a filter media 201 mounted in a low-cost frame 203. The filter media 201 comprises synthetic or natural fibers, woven or knitted materials, foams, or electret or electrostatically charged materials. The filter media 201 may also include sorbents, catalysts, and/or activated carbon (granules, fibers, fabric, and molded shapes). Frame 203 is typically formed from paper products, such as chipboard, or polymeric materials. In a particular implementation, filter media 201 is formed as a pleated media that uses a thermosetting glue bead to hold the pleat shape and provide structural stability. A filter media of this type is available from Columbus Industries available under the product designation Microshield. The glue bead is applied before the folding of the filter media and connects the folds with one another at the point of application.

Downstream electrode 113 is formed by a screen, mesh, or expanded metal structure 213 shown in FIG. 2. Downstream electrode 113 is substantially planar in the particular examples and comprises a conductive material such as steel, aluminum, copper, alloys or the like. Downstream electrode 113 desirably adds minimal airflow resistance while at the same time making frequent, although discontinuous contact with filter media 201. Unlike painted electrodes or other conductive materials that are intimately attached to the filter media, the downstream electrode 113 will occlude little if any of the filter media.

In addition to providing an excellent mechanism to collect charge from filter media 201, downstream electrode 113 also provides mechanical support so that pleats of filter media 201 retain their shape under high airflow. It is contemplated that the contact frequency between the filter media and downstream electrode 113 should be at least one contact point per linear inch of the downstream peak of a filter pleat. Also, the contacts points are substantially evenly distributed across the surface area of the downstream electrode 113.

A common problem with pleated filters is that under high airflow the pleats tend to catch air and blow out like a parachute. This can reduce the effective surface area of the filter media and alter the air flow dynamics of the system. In accordance with the present invention, downstream electrode 113 acts as a mechanical support that keeps the pleat tips aligned with each other even under high airflow loads.

Figure 4:
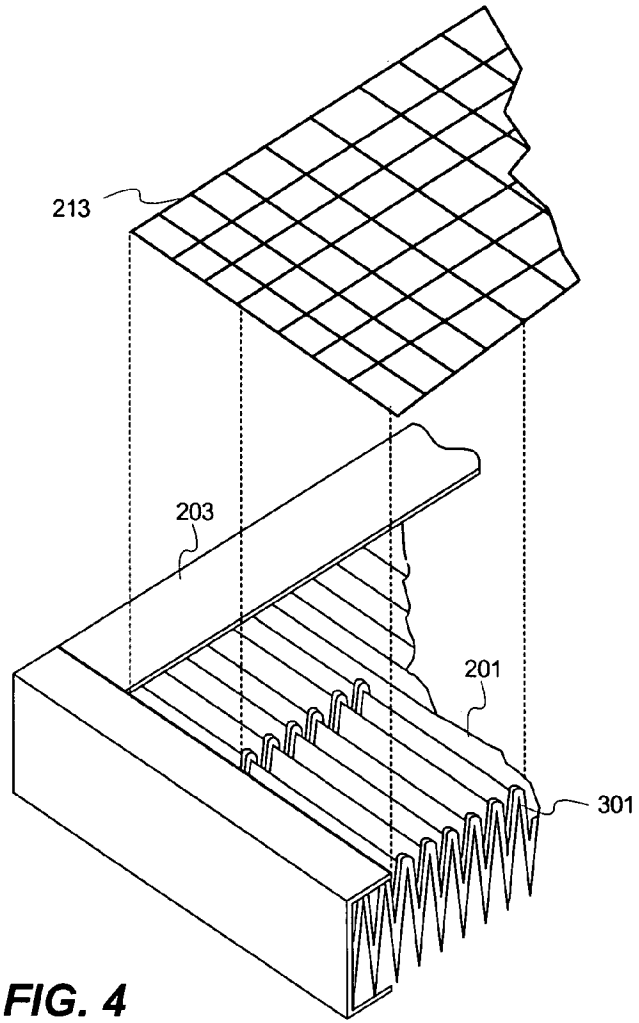
FIG. 4 shows the filter assembly of FIG. 3 during attachment of an electrode.
Figure 3:
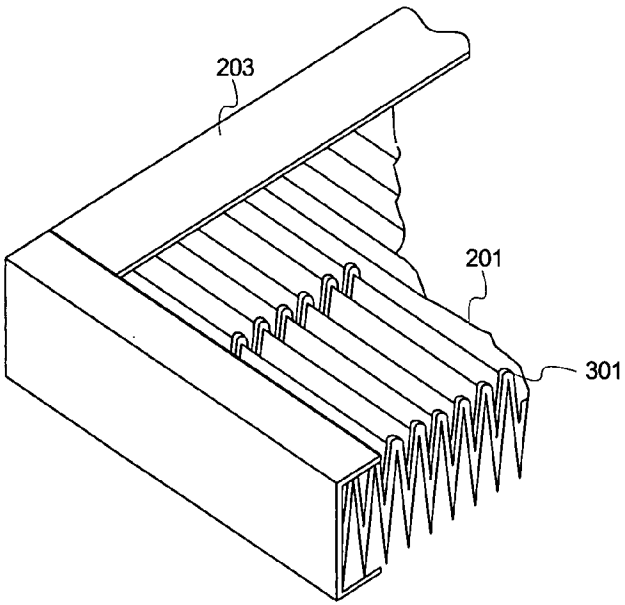
FIG. 3 is a perspective view of a portion of a filter assembly in accordance with the present invention at an early stage of assembly.

Downstream electrode 213 is affixed to filter media 201 using, for example, thermosetting or hot melt glue 301 shown in FIG. 3 and FIG. 4. Glue 301 may be non-conductive as the present invention relies primarily on the physical contact between the filter media 201 and the downstream electrode 213 in the non-glued locations to provide necessary electrical connection. Non-conductive glue is strongly preferred because conductive glue would affect the field shape between downstream electrode 213 and upstream electrode 209 reducing the magnitude of the electric field that can be applied without arcing and resulting in a detrimental distortion of the electric field and non-uniform particle collection in the filter. Glue 301 is shown on only one side of pleated filter media 201 in FIG. 3 and FIG. 4 to ease illustration and understanding, however, a glue bead is typically provided on both sides.

Figure 5:
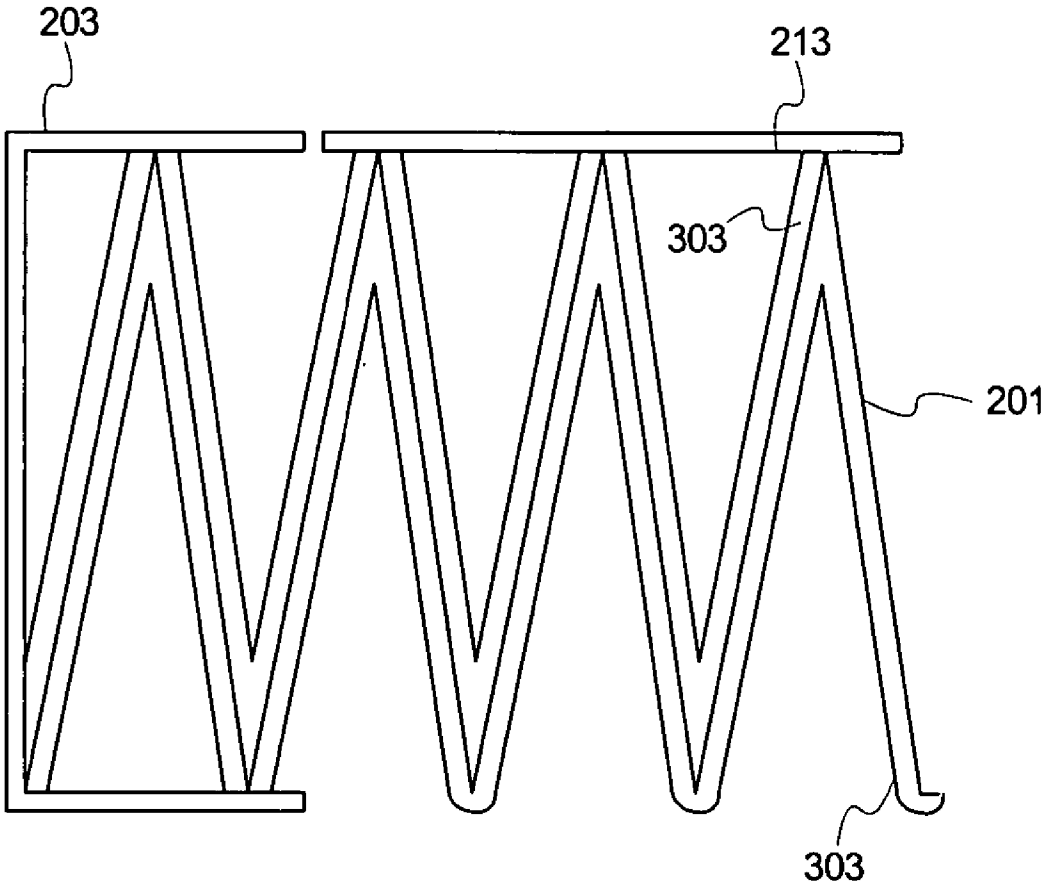
FIG. 5 illustrates a cross-sectional view of a portion of pleated filter assembly.

It is particularly convenient to use excess glue resulting in the formation of pleats in the filter media 201 to affix the downstream electrode 213. The pleats are formed and held in place by a plurality of glue beads spaced a few centimeters apart that extend perpendicular to the pleat direction. The pleating process leaves a bit of excess glue that protrudes above the pleat tips. In particular embodiments, an expanded metal downstream electrode 213 is attached by placing it in contact with a pleated filter media 201 and applying sufficient heat to re-melt the pleating glue that protrudes at the pleat tips. As the pleating glue softens and melts, a slight pressure may be applied to the expanded metal to ensure suitable physical contact as shown in FIG. 5. In this manner, a conventional filter element can be converted for use in an electrically enhanced air filter with minimal difficulty and expense. Alternatively, the downstream electrode can be affixed by a separate gluing operation. In either implementation the manufacture of a system in accordance with the present invention is able use a wide variety of filter shapes and sizes that are provided as standard parts by filter converters and thereby avoid expenses associated with special processing, and the like.

Figure 6C:
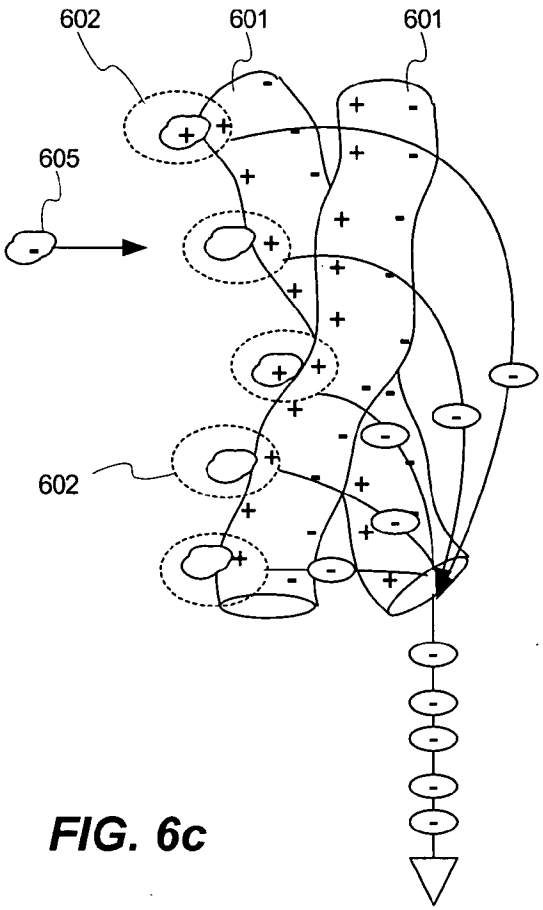
FIG. 6*a* through FIG. 6*c* illustrate a front plan view of two electrified fibers.
Figure 6B:
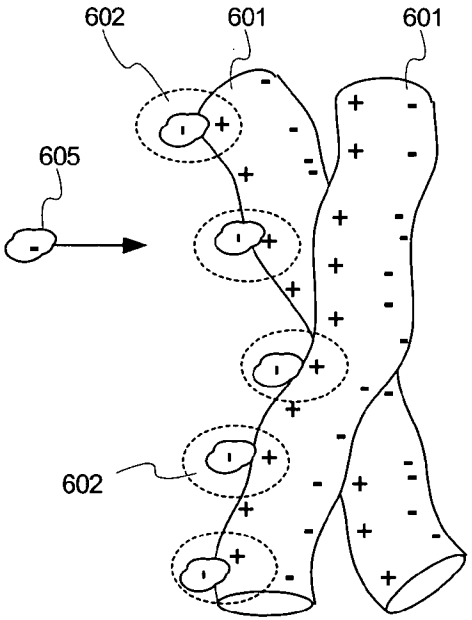
Figure 6A:
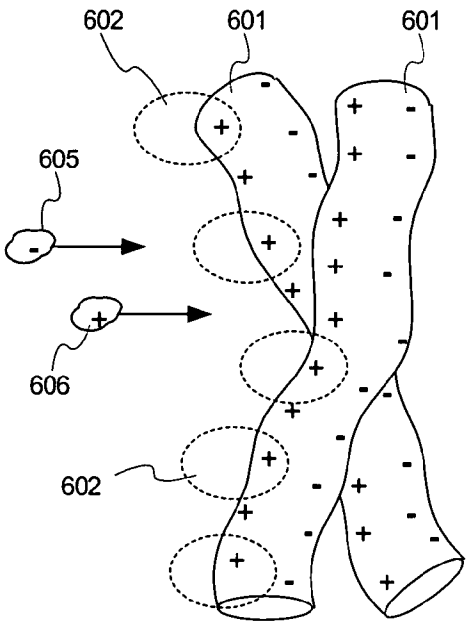

FIG. 6*a* through FIG. 6*c* illustrate how a charged dust particle 105 and 605 is captured by polarized fibers 601. Fibers 601 have been electrified longitudinally with the positive side upstream from the negative side. Particle collection sites 602 on fibers 601 are suggested by the "+" and "–" designations in FIG. 6*a*. Fibers 601 hold a finite amount of charge as determined by their surface area, material composition, and the like. Accordingly, a finite number of particle collection sites 602 exist on fibers 601.

Particle 605 caries a negative charge and is attracted to the positive (upstream) side of fiber 601. Positively charged particle 606 is attracted to the negative (downstream) side of fiber 601. Thus, the system collects all particles regardless of their charged, uncharged, or polarized state all along the surfaces of the fibers 601. As the particular implementations of the present invention described herein use predominantly negatively charged particles 605, the positively charged collection sites 602 are of particular interest in operation. Once the charges that defines a collection site 602 are neutralized by charge from a captured particle 605/606, as shown in FIG. 6*b*, that collection site 602 is no longer available or useful for further electrically enhanced collection.

As shown in FIG. 6*b*, as particles 605 and 606 contact fibers 601, their charge neutralizes or masks charge in the fibers 601 so that particle collection sites 602 become net neutral. This neutralizing effect occurs whether the filter fibers 601 are charged by an externally applied field, frictionally electrostatically charged, or have a permanent bias as in the case of electret filter media. While the net negative charge of particles 605 will cancel out the net positive charge of particles 606, positively charged particles 606 are sufficiently rare that a charge imbalance accumulates in the filter fibers. This accumulation of charge effectively reduces the ability of fibers 601 to attract more charged particles 605.

However, a neutralized charge collection site 602 can be renewed or refreshed by removing the accumulated charge. By coupling fibers 601 to a ground or common potential as shown in FIG. 6C, electrons can migrate along the surface of fibers 601 to be collected by downstream electrode 213. In this manner, the charge balance is removed from fibers 601 and the desired charge state is restored to collection sites 602. Moreover, in an active electrically enhanced filter the captured particles may be polarized by the applied electric field in which case they can actually contribute to further particle capture. In this manner the desired charge state that enhances filter efficiency can be retained throughout the life of the filter element. Of course, at some point the filter media 201 will have captured so many particles that it should be replaced or cleaned, however, even at this late stage of a filter assembly's life the electrical enhancement in accordance with the present invention continues to operate.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A filter assembly comprising:

a fibrous filter media; and a conductive electrode affixed to the fibrous filter media, wherein the conductive electrode makes physical contact to the fibrous filter media in a plurality of substantially planar locations distributed over the entire surface of the filter media.

2. The filter assembly of claim 1 wherein the fibrous filter media comprises a pleated fabric.

3. The filter assembly of claim 1 wherein the fibrous filter media comprises a plurality of parallel pleats defining pleat tips on one surface and wherein the conductive electrode physically contacts the fibrous filter media at the pleat tips.

4. The filter assembly of claim 1 wherein the conductive electrode is substantially planar.

5. The filter assembly of claim 1 wherein the conductive electrode deviates no more than one millimeter variance from planar.

6. The filter assembly of claim 1 wherein the fibrous filter media is substantially nonconductive.

7. The filter assembly of claim 1 wherein the fibrous filter comprise:

a pleated fabric having a plurality of plurality of parallel pleats;

a plurality of glue beads running in a direction non-parallel with respect to the pleats, wherein the glue beads form a protrusion when crossing a pleat tip; and wherein the conductive electrode is affixed to the fibrous filter by the protrusion of the glue bead.

8. The filter assembly of claim 7 wherein the glue bead is substantially non-conductive.

9. The filter assembly of claim 1 further comprising a supporting frame surrounding the fibrous filter media and exposing an upstream surface and a downstream surface of the fibrous filter media, wherein the conductive electrode is affixed to contact only certain points of the downstream surface of the fibrous filter media.

10. The filter assembly of claim 1 wherein the filter assembly is disposable.

11. The filter assembly of claim 1 wherein the conductive electrode makes sufficient physical contact to the fibrous filter media to collect electrical charge imparted anywhere on the fibrous filter media.

12. A method for making a filter media assembly comprising:

providing a fibrous filter media;

affixing a substantially planar conductive electrode to the fibrous filter media such that the conductive electrode physically contacts the fibrous filter media at a plurality of locations distributed over the entire surface of the filter media.

13. The method of claim 12 further comprising:

pleating the fibrous filter media using a glue bead to stabilize the pleats, wherein the act of affixing the conductive electrode comprises using the glue bead to affixing the conductive electrode.

14. The method of claim 12 wherein the fibrous filter media comprises a pleated media having a glue bead running across and intersecting tips of pleats, and the method further comprises:

heating the glue bead; and pressing the conductive electrode into the heated glue bead to affix the conductive electrode to the pleated media.

15. A filter assembly made according to the method of claim 12.

16. An air filtration system including a filter assembly made by the method of claim 12.

17. An air filtration system comprising:

a blower;

a fibrous filter media;

a conductive electrode affixed to the fibrous filter media, wherein the conductive electrode makes physical contact to the fibrous filter media in a plurality of substantially planar locations distributed over the entire surface of the filter media; and an electrical connection coupling the conductive electrode and a voltage source.

18. The air filtration system of claim 17 wherein the conductive electrode makes sufficient physical contact to the fibrous filter media so as to collect charge imparted on the fibrous filter media.

19. The air filtration system of claim 17 further comprising an upstream electrode.

20. The air filtration system of claim 17 further comprising an upstream pre-charge unit.

21. The air filtration system of claim 17 further comprising wherein the filter media is substantially non-conductive.

22. The air filtration system of claim 17 further comprising wherein the conductive electrode is substantially planar.

23. A method for removing particulates from air comprising:

directing air flow through a fibrous filter media;

establishing a substantially uniform electric field across the filter media;

collecting particles on the filter media, whereby charge in a collected particle is distributed to the filter media;

collecting the charge from the filter media using a condutive electrode that is physically coupled to the filter media in a plurality of substantially planar locations distributed over the entire surface of the filter media; and conducting the collected charge to a power supply or ground or opposite polarity.

24. A device, comprising an electrically enhanced air filter, the device comprising:

a functional unit configured to perform a specific function using purified air;

an electrically enhanced air filter positioned upstream of an airflow to the functional unit, the electrically enhanced air filter comprising:

a fibrous filter media;

a conductive electrode affixed to the fibrous filter media, wherein the conductive electrode makes physical contact to the fibrous filter media in a plurality of substantially planar locations distributed over the entire surface of the filter media; and an electrical connection coupling the conductive electrode and a voltage source or ground.

* * * * *